US009603198B2

(12) United States Patent
Liu

(10) Patent No.: US 9,603,198 B2
(45) Date of Patent: Mar. 21, 2017

(54) ATOMIZER AND ELECTRONIC CIGARETTE

(71) Applicant: KIMREE HI-TECH INC., RoadTown, Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 96 days.

(21) Appl. No.: 14/705,261

(22) Filed: May 6, 2015

(65) Prior Publication Data

US 2015/0320115 A1 Nov. 12, 2015

Related U.S. Application Data

(63) Continuation of application No. PCT/CN2014/081371, filed on Jul. 1, 2014.

(30) Foreign Application Priority Data

May 12, 2014 (CN) ..... 2014 2 0241700 U

(51) Int. Cl.
*A24F 47/00* (2006.01)
*H05B 3/44* (2006.01)
*H05B 3/03* (2006.01)

(52) U.S. Cl.
CPC ..... *H05B 3/44* (2013.01); *A24F 47/008* (2013.01); *H05B 3/03* (2013.01); *H05B 2203/014* (2013.01); *H05B 2203/022* (2013.01)

(58) Field of Classification Search
CPC ..... A24F 47/008
See application file for complete search history.

(56) References Cited

U.S. PATENT DOCUMENTS

2014/0053857 A1 2/2014 Liu

FOREIGN PATENT DOCUMENTS

| | | | |
|---|---|---|---|
| CN | 202618275 | U | 12/2012 |
| CN | 203121010 | U | 8/2013 |
| CN | 203168034 | U | 9/2013 |
| CN | 203329913 | U | 12/2013 |
| CN | 203492791 | U | 3/2014 |
| CN | 203538370 | U | 4/2014 |
| CN | 203538386 | U | 4/2014 |

OTHER PUBLICATIONS

International Search Report corresponding to Application No. PCT/CN2014/081371; Date of Mailing: Feb. 15, 2015.

*Primary Examiner* — Alison L Hindenlang
*Assistant Examiner* — Jamel M Nelson
(74) *Attorney, Agent, or Firm* — U.S. Fairsky LLP; Yue Xu

(57) ABSTRACT

An atomizer and an electronic cigarette are provided. The atomizer according to the present application is configured to form an electronic cigarette in combination with a battery assembly, and the atomizer includes a suction nozzle cap, a liquid storage core, a heating wire, an electronic wire A of a heating wire, an electronic wire B of the heating wire, an atomizing sleeve, an elastic insulating sleeve, an outer electrode, and an inner electrode. The electronic wire A of the heating wire has one end connected to one end of the heating wire, and another end clamped between the suction nozzle cap and the atomizing sleeve. The electronic wire B of the heating wire has one end connected to another end of the heating wire, and another end clamped between the elastic insulating sleeve and the inner electrode.

20 Claims, 8 Drawing Sheets

ATOMIZER AND ELECTRONIC CIGARETTE

CROSS REFERENCE TO RELATED APPLICATIONS

This application is a continuation under 35 U.S.C. §120 of PCT/CN2014/081371, filed Jul. 1, 2014, which is incorporated herein reference and which claimed priority under 35 U.S.C. §119 to Chinese Application No. 201420241700.5, filed May 12, 2014, the entire content of which is also incorporated herein by reference.

TECHNICAL FIELD

The present application relates to the technical field of electronic cigarettes, and particularly to an atomizer and an electronic cigarette.

BACKGROUND

An electronic cigarette is a common electronic simulation cigarette product, which mainly includes an atomizer and a battery assembly. The battery assembly supplies electric energy for the atomizer, which enables a heating wire of the atomizer to generate heat to vaporize the cigarette liquid in a liquid guiding core to emit smoke, thereby simulating the real cigarette.

Reference is made to FIG. 1, which is a schematic view showing the structure of a conventional atomizer. In FIG. 1, reference numeral 101 indicates a suction nozzle cap, reference numeral 102 indicates a PVC fiberglass sleeving, reference numeral 103 indicates a high-temperature cotton, reference numeral 104 indicates a PVC fiberglass sleeving, reference numeral 105 indicates an atomizing sleeve, reference numeral 106 indicates an E-shaped cotton, reference numeral 107 indicates an atomizing seat, reference numeral 108 indicates an electronic wire of a heating wire, reference numeral 109 indicates an inner electrode, reference numeral 110 indicates an insulating ring, and reference numeral 111 indicates an outer electrode. According to the structure in the figure, the electronic wire 108 of the heating wire passes through the atomizing seat 107, and then is connected to the inner electrode 109 and the outer electrode 111, respectively, by welding. Therefore, the connection manner of the electronic wire of the atomizer in the conventional electronic cigarette has the following defects.

1. The electronic wire 108 of the heating wire is connected to the inner electrode 109 by welding, thus the electrode hole is prone to be blocked by soldering tin, which may block the path of the smoke channel or cause different ventilating areas, thereby causing a poor user experience.

2. The electronic wire 108 of the heating wire is connected to the inner electrode 109 and the outer electrode 111, which is prone to cause poor soldering, for example, false soldering or pseudo soldering, thus the circuit may be disconnected, which further affects the user using the electronic cigarette.

Thus, in view of this, a technical issue to be solved presently by those skilled in the art is to improve the connection of the electronic wire of the heating wire in the atomizer and other components of the electronic cigarette, to address the above problems.

SUMMARY

An atomizer and an electronic cigarette are provided by the present application, wherein an electronic wire at one end of a heating wire is clamped between a suction nozzle cap and an atomizing sleeve, and then is electrically connected to an outer electrode via the atomizing sleeve, and an electronic wire at another end of the heating wire is clamped between an elastic insulating sleeve and an inner electrode, such that it ensures that the electronic wires of the heating wire are tightly connected to the outer electrode and the inner electrode, respectively, without blocking an air path, which facilitates assembling and improves production efficiency.

The atomizer according to the present application is configured to form an electronic cigarette in combination with a battery assembly, and the atomizer includes a suction nozzle cap, a liquid storage core, a heating wire, an electronic wire A of the heating wire, an electronic wire B of the heating wire, an atomizing sleeve, an elastic insulating sleeve, an outer electrode, and an inner electrode;

the suction nozzle cap and the outer electrode are inserted into two ends of the atomizing sleeve, respectively; the inner electrode is inserted in the outer electrode, and the elastic insulating sleeve is sleeved on the inner electrode; the electronic wire A of the heating wire has one end connected to one end of the heating wire, and another end clamped between an outer circumferential surface of the suction nozzle cap and an inner circumferential surface of the atomizing sleeve and electrically connected to the outer electrode via the atomizing sleeve; and the electronic wire B of the heating wire has one end connected to another end of the heating wire, and another end clamped between an inner circumferential surface of the elastic insulating sleeve and an outer circumferential surface of the inner electrode and electrically connected to the inner electrode.

Preferably, the heating wire is of a hollow spiral cylindrical structure, and is arranged in an axial direction of the atomizer.

Preferably, the liquid storage core is of a hollow cylindrical structure and encloses the heating wire.

Preferably, the suction nozzle cap is an elastic non-metallic member.

Preferably, the elastic insulating sleeve is arranged between the outer electrode and the inner electrode to insulate the outer electrode from the inner electrode.

Preferably, a fixing pattern is provided on the outer circumferential surface of the suction nozzle cap to fix the electronic wire A of the heating wire;

and/or, a fixing pattern is provided on the outer circumferential surface of the inner electrode to fix the electronic wire B of the heating wire.

Preferably, the fixing pattern of the suction nozzle cap is a wavy pattern;

the suction nozzle cap is provided with a guiding region, and the guiding region is arranged below the wavy pattern and is configured to lead in the electronic wire A of the heating wire; and a groove with an E-shaped section is provided at the bottom of the suction nozzle cap, and a through hole is provided in the middle of the groove.

Preferably, the fixing pattern of the suction nozzle cap is a wavy pattern; the suction nozzle cap is provided with a guiding region, and the guiding region is arranged below the wavy pattern and is configured to lead in the electronic wire A of the heating wire; a central through hole is provided at the center of the bottom of the suction nozzle cap; and a circular groove is provided at the bottom of the suction nozzle cap and is connected to the central through hole.

Preferably, the atomizer further includes a sealing member arranged between the suction nozzle cap and the liquid storage core.

Preferably, an outer circumferential surface of the sealing member is provided with a wavy pattern; and the sealing member is provided with a guiding region, and the guiding region is arranged below the wavy pattern.

Preferably, the sealing member is an elastic non-metallic member.

Preferably, a through hole is provided in the middle of the suction nozzle cap, and a retaining portion is provided on the suction nozzle cap; the sealing member is provided with a retaining groove for cooperating with the retaining portion; and the electronic wire A of the heating wire is clamped between an outer circumferential surface of the sealing member and the inner circumferential surface of the atomizing sleeve.

Preferably, the fixing pattern on the inner electrode is screw threads or a wavy pattern.

An electronic cigarette according to present application includes an atomizer and a battery assembly which is connected to the atomizer, and the atomizer is the above atomizer.

The atomizer and the electronic cigarette according to the present application have the following beneficial effects.

1. The electronic wire at one end of the heating wire is clamped between the suction nozzle cap and the atomizing sleeve, and is electrically connected to the outer electrode via the atomizing sleeve, and then the electronic wire at another end of the heating wire is clamped between the elastic insulating sleeve and the inner electrode. Thus, it ensures that the electronic wires of the heating wire are tightly connected to the outer electrode and the inner electrode, respectively, without blocking the air path, which facilitates the assembly, and improves production efficiency.

2. The suction nozzle cap is provided with a guiding region which can guide the suction nozzle cap when it is being mounted into the atomizing sleeve, and at the same time, avoid the entire electronic wire A of the heating wire being pressed into the atomizing sleeve.

3. Due to the fixing pattern on the suction nozzle cap, the electronic wire A of the heating wire is in a tight contact with the atomizing sleeve, to form a multipoint electricity conduction, which can avoids the problems in the conventional technology that the electronic wire A of the heating wire is required to pass through the atomizing seat to be welded to the outer electrode, which may causes an inconvenient assembly and an unreliable electric connection.

4. The electronic wire B of the heating wire is in a tight contact with the fixing pattern of the inner electrode, to form a multipoint electricity conduction, which can avoids the problems that the electronic wire B of the heating wire is required to pass through the atomizing seat to be welded to the inner electrode, which may causes an inconvenient assembly and an unreliable electric connection.

5. The atomizer according to the present application employs the suction nozzle cap and the inner electrode to clamp the electronic wire of the heating wire to fix the electronic wire of the heating wire, thus a soldering process is not required in the assembly of the atomizer, which reduces the assembling time and cost of the atomizer, and avoids the environmental pollution caused by the soldering process.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art, other drawings may be obtained based on these drawings without any creative efforts.

DETAILED DESCRIPTION

An atomizer and an electronic cigarette are provided by the present application, wherein an electronic wire at one end of a heating wire is clamped between a suction nozzle cap and an atomizing sleeve, and then is electrically connected to an outer electrode via the atomizing sleeve, and an electronic wire at another end of the heating wire is clamped between an elastic insulating sleeve and an inner electrode, such that it ensures that the electronic wires of the heating wire are tightly connected to the outer electrode and the inner electrode, respectively, without blocking the air path, which facilitates assembling and improves production efficiency.

Figure 1:
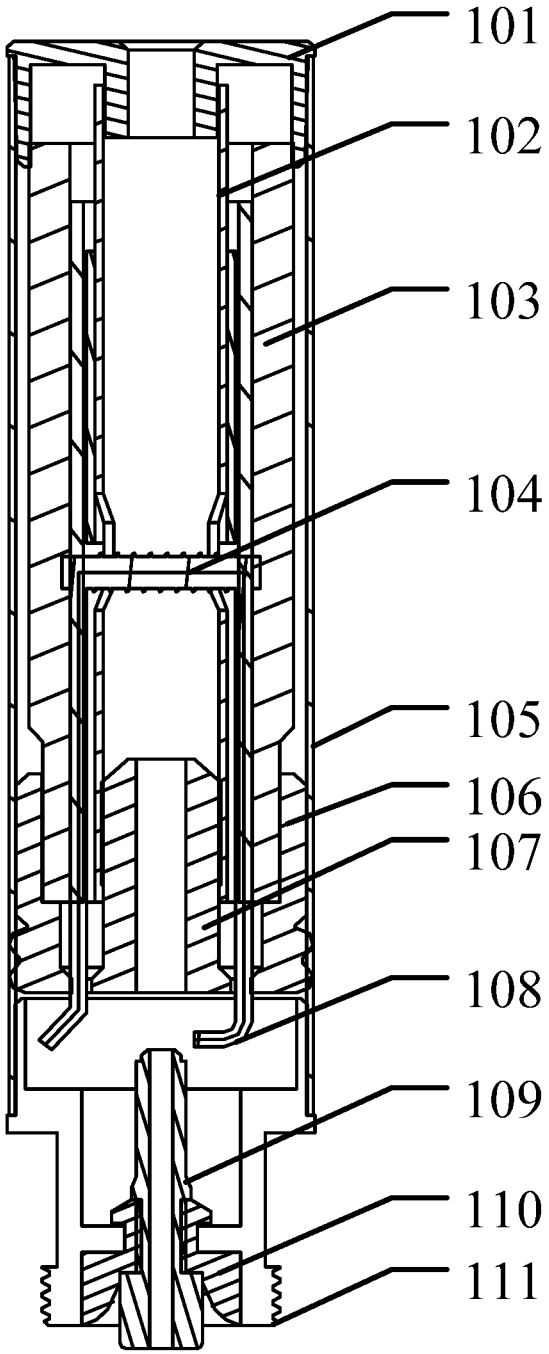
Figure 1 Prior Art
FIG. 1 is a structural schematic view showing the connection of an electronic wire of a heating wire in an atomizer of a conventional electronic cigarette.
Figure 2:
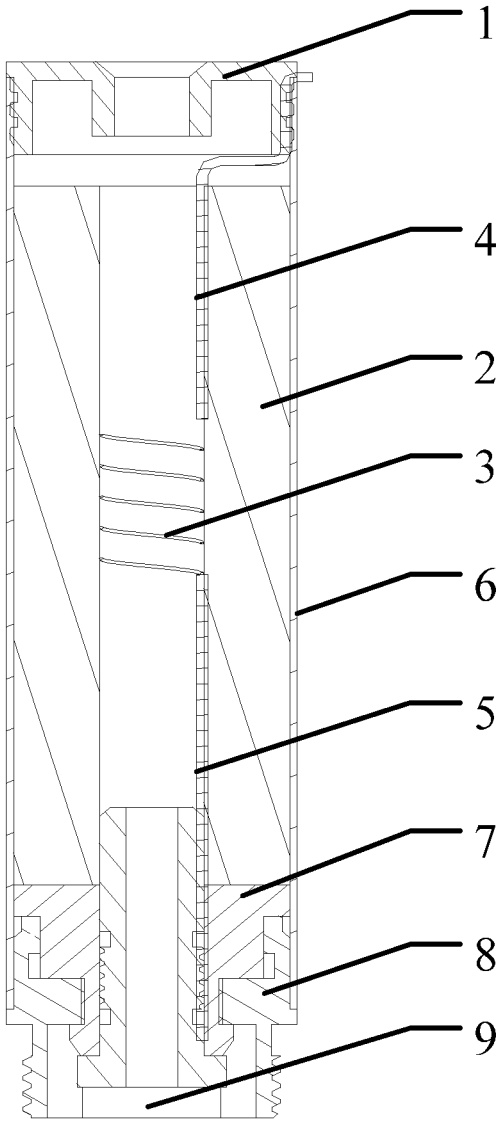
FIG. 2 is a schematic view showing the structure of an atomizer according to the present application.
Figure 3:
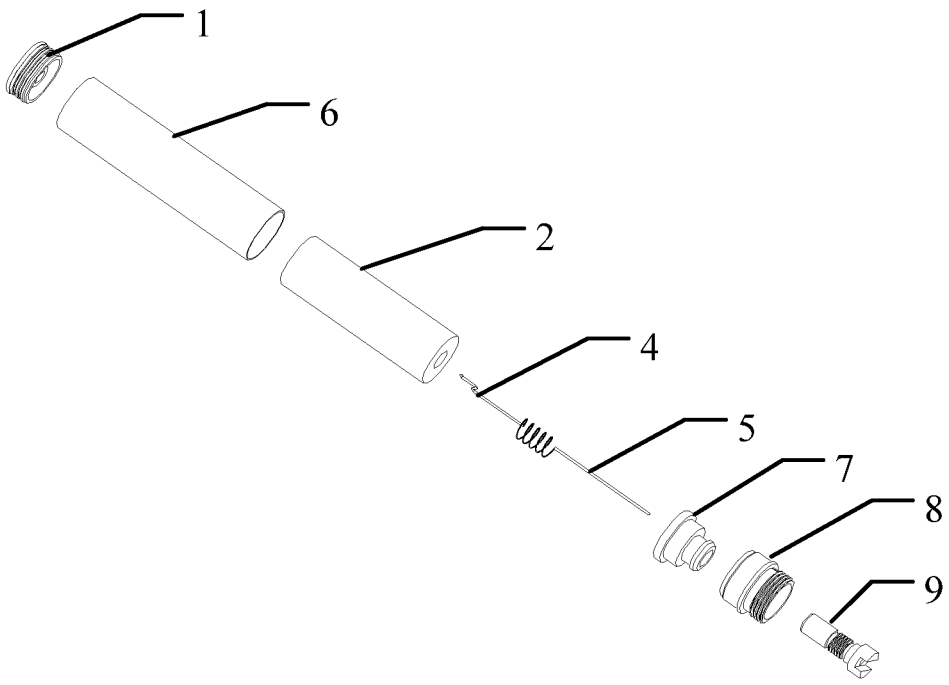
FIG. 3 is an exploded view of the atomizer according to the present application.

Reference is made to FIG. 2 and FIG. 3. An atomizer is provided according to the present application, which employs a suction nozzle cap to clamp an electronic wire, and is configured to be combined with a battery assembly to form an electronic cigarette. The atomizer includes a suction nozzle cap 1, a liquid storage core 2, a heating wire 3, an electronic wire A4 of the heating wire, an electronic wire B5 of the heating wire, an atomizing sleeve 6, an elastic insulating sleeve 7, an outer electrode 8 and an inner electrode 9. The atomizing sleeve 6 may be made of metallic material, or an electrically conductive layer is arranged on an inner wall of the atomizing sleeve 6, and the present application is not limited to this.

The suction nozzle cap 1 and the outer electrode 8 are inserted in two ends of the atomizing sleeve 6, respectively. The inner electrode 9 is inserted in the outer electrode 8. The elastic insulating sleeve 7 is sleeved on the inner electrode 9. The electronic wire A4 of the heating wire has one end connected to one end of the heating wire 3, and another end clamped between an outer circumferential surface of the suction nozzle cap 1 and an inner circumferential surface of the atomizing sleeve 6 and electrically connected to the outer electrode 8 via the atomizing sleeve 6.

The electronic wire B5 of the heating wire has one end connected to another end of the heating wire 3, and another end clamped between an inner circumferential surface of the elastic insulating sleeve 7 and an outer circumferential surface of the inner electrode 9 and electrically connected to the inner electrode 9.

The atomizer according to the present application employs the suction nozzle cap to clamp the electronic wire, and is configured to be combined with a battery assembly to form an electronic cigarette. The atomizer includes the suction nozzle cap 1, the liquid storage core 2, the heating wire 3, the electronic wire A4 of the heating wire, the electronic wire B5 of the heating wire, the atomizing sleeve 6, the elastic insulating sleeve 7, the outer electrode 8 and the inner electrode 9. Since the atomizer is connected to the battery assembly via the outer electrode 8 and the inner electrode 9, the heating wire 3 of the atomizer is required to be connected to the outer electrode 8 and the inner electrode 9. In the present application, the heating wire 3 includes the electronic wire A4 and the electronic wire B5, wherein the electronic wire A4 of the heating wire is led along an inner circumferential surface of an upper end of the liquid storage core 2 to be installed between the outer circumferential surface of the suction nozzle cap 1 and the inner circumferential surface of the atomizing sleeve 6, and then is fixed by a fixing pattern on the outer circumferential surface of the suction nozzle cap 1. The electronic wire B5 of the heating wire is led along an inner circumferential surface of a lower end of the liquid storage core 2 to be installed between the inner circumferential surface of the elastic insulating sleeve 7 and the outer circumferential surface of the inner electrode 9, and is fixed by a fixing pattern on the outer circumferential of the inner electrode 9.

Since the electronic wires of the heating wire 3 are tightly connected to the outer electrode 8 and the inner electrode 9, respectively, without welding, the atomizer according to the present application has the following beneficial effects.

1. The electronic wire at one end of the heating wire is pressed into the atomizing sleeve by the suction nozzle cap 1, and is connected to the outer electrode via the atomizing sleeve 6, and then the electronic wire at another end of the heating wire is pressingly connected to the inner electrode 9 by the fixing pattern. Thus, it ensures that the electronic wires of the heating wire are tightly connected to the outer electrode 8 and the inner electrode 9, respectively, without blocking the air path.

2. The suction nozzle cap 1 is provided with a guiding region which can guide the suction nozzle cap 1 when it is being mounted into the atomizing sleeve 6, and at the same time, avoid the entire electronic wire A of the heating wire being pressed into the atomizing sleeve 6.

3. Due to the fixing pattern on the suction nozzle cap 1, the electronic wire A4 of the heating wire is in a tight contact with the atomizing sleeve 6, to form a multipoint electricity conduction, thus the electronic wire A of the heating wire is not required to pass through the atomizing seat 7 to be welded to the outer electrode 8.

4. The electronic wire B of the heating wire is in a tight contact with the fixing pattern of the inner electrode 9, to form a multipoint electricity conduction, thus the electronic wire B of the heating wire is not required to pass through the atomizing seat 7 to be welded to the inner electrode 9.

5. The atomizer according to the present application employs the suction nozzle cap and the inner electrode to clamp the electronic wire of the heating wire to fix the electronic wire of the heating wire, thus a soldering process is not required in the assembly of the atomizer, which reduces the assembling time and cost of the atomizer, and avoids the environmental pollution caused by the soldering process.

The suction nozzle cap 1 is an elastic non-metallic member.

The suction nozzle cap 1 may be made of soft plastic with elasticity, such as rubber or silica gel. The suction nozzle cap 1 made of soft plastic with elasticity may facilitate mounting the suction nozzle cap 1 to the atomizer, and at the same time, may better fix the electronic wire A4 of the heating wire.

The liquid storage core 2 is of a hollow cylindrical structure, and covers the heating wire 3. The liquid storage core 2 may be made of cotton or fiber, which is not limited herein.

The heating wire 3 is of a hollow spiral cylindrical structure and is arranged in the axial direction of the atomizer.

The hollow spiral cylindrical structure may effectively increase the length of the heating wire 3 and a contacting area between the heating wire 3 and the cigarette liquid, which avoids a defect in the conventional technology that the requirement for the smoke amount of a user cannot be satisfied due to the limited contacting area between the heating wire 3 arranged in the transverse direction of the atomizer and the cigarette liquid. This hollow spiral cylindrical structure breaks through the bottleneck of the limited smoke amount of the conventional electronic cigarette, and avoids the defects in the conventional technology that the current is increased to increase the smoke amount, which causes the smoke have an overly high temperature, and causes a poor imitation for the real cigarette and mouth discomfort.

The elastic insulating sleeve 7 is arranged between the outer electrode 8 and the inner electrode 9 to isolate the outer electrode 8 from the inner electrode 9. Such arrangement may not only make the connection between the electronic wire B5 of the heating wire and the inner electrode 9 more reliable, but also save the cost since no additional fixing structure is required.

A fixing pattern is provided on the outer circumferential surface of the suction nozzle cap 1 to fix the electronic wire A4 of the heating wire; and/or, a fixing pattern is provided on the outer circumferential surface of the inner electrode 9 to fix the electronic wire B5 of the heating wire.

The fixing pattern on the suction nozzle cap 1 is a wavy pattern 11. The suction nozzle cap 1 is provided with a guiding region 12, and the guiding region 12 is arranged below the wavy pattern 11 to lead in the electronic wire A4 of the heating wire. A groove having an E-shaped section is provided at a bottom of the suction nozzle cap 1, and a through hole is provided in a middle of the groove.

Figure 4:
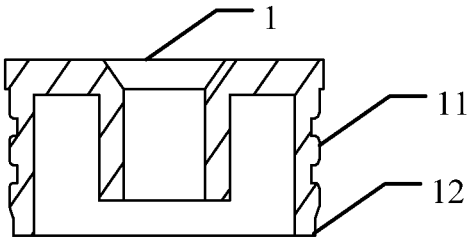
FIG. 4 is a sectional view of a first example of a suction nozzle cap according to the present application.

Reference is made to FIG. 4. The suction nozzle cap 1 is provided with the guiding region 12, thus in assembly, the guiding region 12 may have a guiding and positioning function, which facilitates mounting the suction nozzle cap 1 and fixing the electronic wire A4 of the heating wire.

Figure 5:
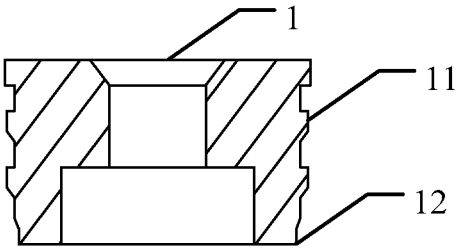
FIG. 5 is a sectional view of a second example of the suction nozzle cap according to the present application.
Figure 6:
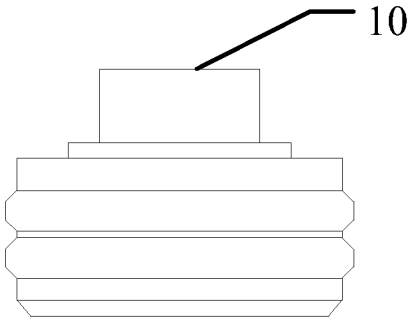
FIG. 6 is a schematic view showing the structure of a sealing member according to the present application.
Figure 7:
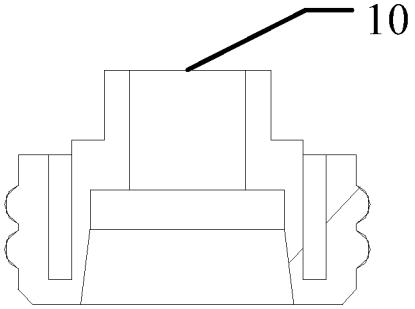
FIG. 7 is a sectional view of the sealing member according to the present application.
Figure 8:
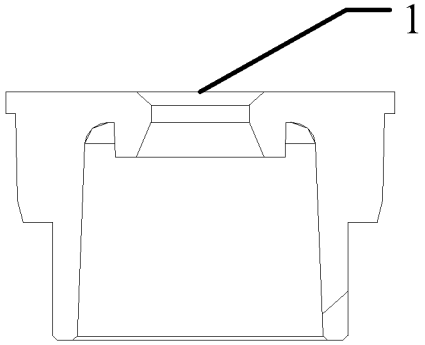
FIG. 8 is a schematic view showing the structure of the suction nozzle cap configured to cooperate with the sealing member according to the present application.
Figure 9:
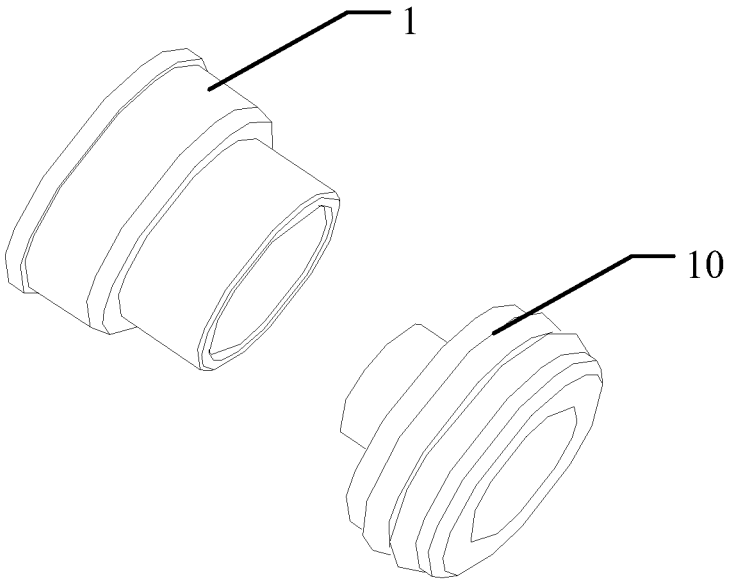
FIG. 9 is a sectional view of the suction nozzle cap configured to cooperate with the sealing member according to the present application.
Figure 10:
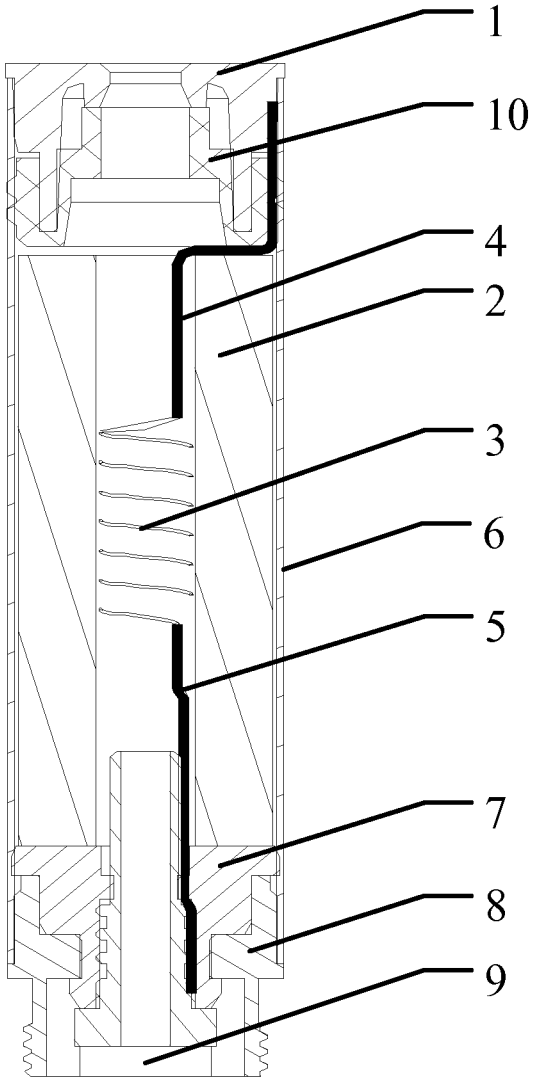
FIG. 10 is a schematic view showing the structure of the atomizer having the sealing member according to the present application.
Figure 11:
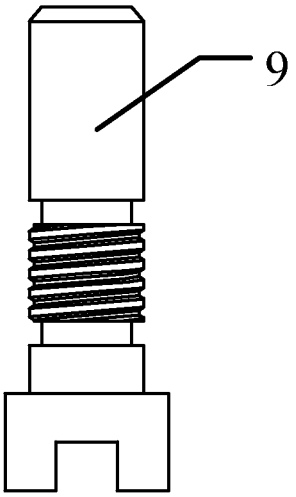
FIG. 11 is a schematic view showing the structure of an inner electrode with screw threads according to the present application.
Figure 12:
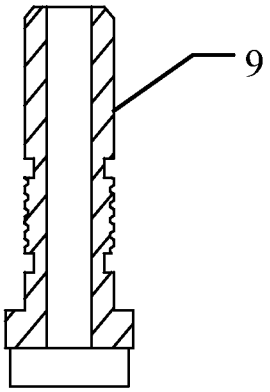
FIG. 12 is a sectional view of the inner electrode with screw threads according to the present application.
Figure 13:
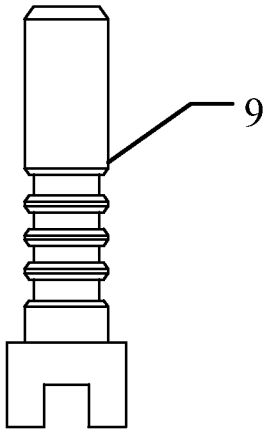
FIG. 13 is a schematic view showing the structure of an inner electrode with a wavy pattern according to the present application.
Figure 14:
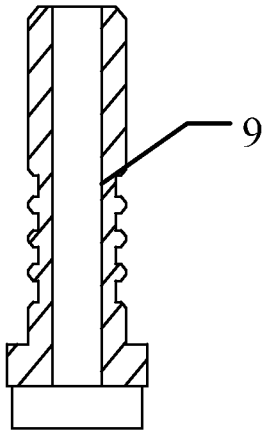
FIG. 14 is a sectional view of the inner electrode with a wavy pattern according to the present application.

Referring to FIG. 5, the fixing pattern of the suction nozzle cap 1 is a wavy pattern 11. The suction nozzle cap 1 is provided with the guiding region 12, and the guiding region 12 is arranged below the wavy pattern 11 to lead in the electronic wire A4 of the heating wire. A central through hole is provided at a center of the bottom of the suction nozzle cap 1. A circular groove is provided at the bottom of the suction nozzle cap 1 and is connected to the central through hole.

The atomizer further includes a sealing member. The sealing member is arranged between the suction nozzle cap and the liquid storage core.

The outer circumferential surface of the sealing member is provided with a wavy pattern, and the sealing member is provided with a guiding region, and the guiding region is arranged below the wavy pattern.

The sealing member is an elastic non-metallic member.

A through hole is provided at the middle of the suction nozzle cap, and a retaining portion is provided on the suction nozzle cap. The sealing member is provided with a retaining groove for cooperating with the retaining portion. The electronic wire A of the heating wire is clamped between the outer circumferential surface of the sealing member and the inner circumferential surface of the atomizing sleeve.

Reference is made to FIG. 6 to FIG. 10. The sealing member 10 is an elastic non-metallic member. Thus, when the suction nozzle cap 1 and the sealing member 10 are mounted on the atomizer and the electronic wire A4 of the heating wire is pressed to the inner circumferential surface of the atomizing sleeve 6, the electronic wire A4 of the heating wire may be tightly pressed on the inner circumferential surface of the atomizing sleeve 6 under the elastic force of the sealing member 10 without being damaged.

The fixing pattern on the inner electrode is screw threads or a wavy pattern.

Reference is made to FIG. 11 to FIG. 14. It should be noted that, other than the screw threads or the wavy pattern, the fixing pattern on the inner electrode 9 may also be other patterns that can fix the electronic wire B of the heating wire, such as a saw-toothed pattern, and the present application is not limited to this.

The atomizer according to the present application is briefly described hereinabove, and has the following beneficial effects.

1. The electronic wire at one end of the heating wire is pressed into the atomizing sleeve by the suction nozzle cap, and is connected to the outer electrode via the atomizing sleeve, and then the electronic wire at another end of the heating wire is pressingly connected to the inner electrode by the fixing pattern. Thus, it ensures that the electronic wires of the heating wire are tightly connected to the outer electrode and the inner electrode, respectively, without blocking the air path.

2. The suction nozzle cap is provided with the guiding region which can guide the suction nozzle cap when it is being mounted into the atomizing sleeve, and at the same time, avoid the entire electronic wire A of the heating wire being pressed into the atomizing sleeve.

3. Due to the fixing pattern on the suction nozzle cap, the electronic wire A of the heating wire is in a tight contact with the atomizing sleeve, to form a multipoint electricity conduction, thus the electronic wire A of the heating wire is not required to pass through the atomizing seat to be welded to the outer electrode.

4. The electronic wire B of the heating wire is in a tight contact with the fixing pattern of the inner electrode, to form a multipoint electricity conduction, thus the electronic wire B of the heating wire is not required to pass through the atomizing seat to be welded to the inner electrode.

5. The sealing ring of the suction nozzle cap is provided with the guiding structure, thus the guiding structure may guide the sealing ring when it is mounted into the atomizing sleeve, and at the same time, avoid the entire electronic wire of the heating wire being pressed into the atomizing sleeve.

6. Due to the wavy pattern on the sealing ring of the suction nozzle cap, the electronic wire of the heating wire is in a tight contact with the metallic atomizing sleeve, to form a multipoint electricity conduction, thus the heating wire is not required to pass through the atomizing seat to be welded to the outer electrode.

7. The atomizer according to the present application employs the suction nozzle cap and the inner electrode to clamp the electronic wire of the heating wire to fix the electronic wire of the heating wire, thus a soldering process is not required in the assembly of the atomizer, which reduces the assembling time and cost of the atomizer, and avoids the environmental pollution caused by the soldering process.

The electronic cigarette according to the present application is described hereinafter, which includes an atomizer and a battery assembly, and the battery assembly is connected to the atomizer, and the atomizer is the atomizer described in the above embodiments according to the present application. In this embodiment, the atomizer may be detachably connected to the battery assembly. It will be appreciated that, the atomizer and the battery assembly may also be formed as an integral structure which is not detachable, and the present application is not limited to this.

Since the atomizer of the electronic cigarette according to the present application has the same as the atomizer according to the present application, the electronic cigarette according to the present application also has the same technical effects. The battery assembly is a conventional battery assembly, which will not be described herein.

The atomizer and the electronic cigarette according to the present application are described in detail hereinbefore. The principle and the embodiments of the present application are illustrated herein by specific examples. The above description of examples is only intended to help the understanding of the method and the idea of the present application. It should be noted that, for the person skilled in the art, a few of modifications and improvements may be made to the present application without departing from the principle of the present application, and these modifications and improvements are also deemed to fall into the scope of the present application defined by the claims.

The invention claimed is:

1. An atomizer, configured to form an electronic cigarette in combination with a battery assembly, wherein the atomizer comprises a suction nozzle cap, a liquid storage core, a heating wire, an electronic wire A of the heating wire, an electronic wire B of the heating wire, an atomizing sleeve, an elastic insulating sleeve, an outer electrode, and an inner electrode;

the suction nozzle cap and the outer electrode are inserted into two ends of the atomizing sleeve, respectively; the inner electrode is inserted in the outer electrode, and the elastic insulating sleeve is sleeved on the inner electrode; the electronic wire A of the heating wire has one end connected to one end of the heating wire, and another end clamped between an outer circumferential surface of the suction nozzle cap and an inner circumferential surface of the atomizing sleeve and electrically connected to the outer electrode via the atomizing sleeve; and the electronic wire B of the heating wire has one end connected to another end of the heating wire, and another end clamped between an inner circumferential surface of the elastic insulating sleeve and an outer circumferential surface of the inner electrode and electrically connected to the inner electrode.

2. The atomizer according to claim 1, wherein the heating wire is of a hollow spiral cylindrical structure, and is arranged in an axial direction of the atomizer.

3. The atomizer according to claim 1, wherein the liquid storage core is of a hollow cylindrical structure and encloses the heating wire.

4. The atomizer according to claim 1, wherein the suction nozzle cap is an elastic non-metallic member.

5. The atomizer according to claim 1, wherein the elastic insulating sleeve is arranged between the outer electrode and the inner electrode to insulate the outer electrode from the inner electrode.

6. The atomizer according to claim 1, wherein a fixing pattern is provided on the outer circumferential surface of the suction nozzle cap to fix the electronic wire A of the heating wire;

and/or, a fixing pattern is provided on the outer circumferential surface of the inner electrode to fix the electronic wire B of the heating wire.

7. The atomizer according to claim 6, wherein the fixing pattern of the suction nozzle cap is a wavy pattern;

the suction nozzle cap is provided with a guiding region, and the guiding region is arranged below the wavy pattern and is configured to lead in the electronic wire A of the heating wire; and a groove with an E-shaped section is provided at the bottom of the suction nozzle cap, and a through hole is provided in the middle of the groove.

8. The atomizer according to claim 6, wherein the fixing pattern of the suction nozzle cap is a wavy pattern;

the suction nozzle cap is provided with a guiding region, and the guiding region is arranged below the wavy pattern and is configured to lead in the electronic wire A of the heating wire;

a central through hole is provided at the center of the bottom of the suction nozzle cap; and a circular groove is provided at the bottom of the suction nozzle cap and is connected to the central through hole.

9. The atomizer according to claim 7, further comprising a sealing member arranged between the suction nozzle cap and the liquid storage core.

10. The atomizer according to claim 9, wherein, an outer circumferential surface of the sealing member is provided with a wavy pattern; and the sealing member is provided with a guiding region, and the guiding region is arranged below the wavy pattern.

11. The atomizer according to claim 9, wherein the sealing member is an elastic non-metallic member.

12. The atomizer according to claim 9, wherein a through hole is provided in the middle of the suction nozzle cap, and a retaining portion is provided on the suction nozzle cap;

the sealing member is provided with a retaining groove for cooperating with the retaining portion; and the electronic wire A of the heating wire is clamped between an outer circumferential surface of the sealing member and the inner circumferential surface of the atomizing sleeve.

13. The atomizer according to claim 8, further comprising a sealing member arranged between the suction nozzle cap and the liquid storage core.

14. The atomizer according to claim 13, wherein, an outer circumferential surface of the sealing member is provided with a wavy pattern; and the sealing member is provided with a guiding region, and the guiding region is arranged below the wavy pattern.

15. The atomizer according to claim 13, wherein the sealing member is an elastic non-metallic member.

16. The atomizer according to claim 13, wherein a through hole is provided in the middle of the suction nozzle cap, and a retaining portion is provided on the suction nozzle cap;

the sealing member is provided with a retaining groove for cooperating with the retaining portion; and the electronic wire A of the heating wire is clamped between an outer circumferential surface of the sealing member and the inner circumferential surface of the atomizing sleeve.

17. The atomizer according to claim 6, wherein the fixing pattern on the inner electrode is screw threads or a wavy pattern.

18. An electronic cigarette, comprising an atomizer and a battery assembly connected to the atomizer, wherein the atomizer comprises a suction nozzle cap, a liquid storage core, a heating wire, an electronic wire A of the heating wire, an electronic wire B of the heating wire, an atomizing sleeve, an elastic insulating sleeve, an outer electrode, and an inner electrode;

the suction nozzle cap and the outer electrode are inserted into two ends of the atomizing sleeve, respectively; the inner electrode is inserted in the outer electrode, and the elastic insulating sleeve is sleeved on the inner electrode; the electronic wire A of the heating wire has one end connected to one end of the heating wire, and another end clamped between an outer circumferential surface of the suction nozzle cap and an inner circumferential surface of the atomizing sleeve and electrically connected to the outer electrode via the atomizing sleeve; and the electronic wire B of the heating wire has one end connected to another end of the heating wire, and another end clamped between an inner circumferential surface of the elastic insulating sleeve and an outer circumferential surface of the inner electrode and electrically connected to the inner electrode.

19. The electronic cigarette according to claim 18, wherein the elastic insulating sleeve is arranged between the outer electrode and the inner electrode to insulate the outer electrode from the inner electrode.

20. The electronic cigarette according to claim 18, wherein a fixing pattern is provided on the outer circumferential surface of the suction nozzle cap to fix the electronic wire A of the heating wire;

and/or, a fixing pattern is provided on the outer circumferential surface of the inner electrode to fix the electronic wire B of the heating wire.

* * * * *